US005253426A

United States Patent [19]

Mosbrucker

[11] Patent Number: 5,253,426

[45] Date of Patent: Oct. 19, 1993

[54] MULTI-PURPOSE SQUARE

[76] Inventor: Gregory A. Mosbrucker, 2150 NE. 137th St., Portland, Oreg. 97230

[21] Appl. No.: 872,801

[22] Filed: Apr. 23, 1992

[51] Int. Cl.[5] ..... B43L 7/027

[52] U.S. Cl. ..... 33/429; 33/451; 33/474; 33/476

[58] Field of Search ..... 33/451, 429, 479, 480, 33/481, 759, 760, 474, 476, 42, 415, 416, 417, 423, 424, 403, 613, 562

[56] References Cited

U.S. PATENT DOCUMENTS

| | | | |
|---|---|---|---|
| Re. 12,119 | 6/1903 | Oehrle . | |
| 303,666 | 8/1884 | Ritchie . | |
| 324,323 | 8/1885 | Howard | 33/451 |
| 359,372 | 3/1887 | Warnock . | |
| 509,292 | 11/1893 | Bretz | 33/451 |
| 732,379 | 6/1903 | Shireman | 33/480 X |
| 911,330 | 2/1909 | Randall . | |
| 945,684 | 1/1910 | Blair . | |
| 1,007,539 | 10/1911 | Criss . | |
| 1,255,429 | 2/1918 | Killion | 33/429 |
| 1,610,803 | 12/1926 | McReynolds . | |
| 1,841,972 | 1/1932 | Moslem . | |
| 2,026,274 | 12/1935 | Doyle | 33/429 |
| 2,122,732 | 7/1938 | Oyeda et al. | 33/474 |
| 2,246,260 | 6/1941 | McGrath | 33/480 |
| 2,470,035 | 5/1949 | Hudkins . | |
| 2,652,629 | 9/1953 | Prucker | 33/474 |
| 2,728,989 | 1/1956 | Laggren . | |
| 2,745,183 | 5/1956 | DeQueen . | |
| 3,169,320 | 2/1965 | Currie | 33/613 X |
| 3,522,657 | 8/1970 | Metrulis . | |
| 4,151,650 | 5/1979 | Russo . | |
| 4,348,815 | 9/1982 | Hurt . | |
| 4,394,801 | 7/1983 | Thibodeaux . | |
| 4,499,666 | 2/1985 | Smith | 33/562 |
| 4,503,624 | 3/1985 | Whiteford . | |
| 4,697,351 | 10/1987 | Hopfer . | |
| 4,813,149 | 3/1989 | Herkimer . | |
| 4,914,825 | 4/1990 | Howard . | |

FOREIGN PATENT DOCUMENTS

| | | | |
|---|---|---|---|
| 892062 | 7/1949 | Fed. Rep. of Germany | 33/480 |
| 896418 | 11/1953 | Fed. Rep. of Germany | 33/480 |
| 84798 | 3/1965 | France | 33/451 |

*Primary Examiner*—William A. Cuchlinski, Jr.
*Assistant Examiner*—Alvin Wirthlin
*Attorney, Agent, or Firm*—William A. Birdwell & Associates

[57] ABSTRACT

A layout square having a handle and two legs that extend away from the handle in the same direction, both perpendicular to the handle. The handle includes a level to allow angular measurements against level, as well as for plumbing and leveling purposes. The legs correspond in width to standard dimensions of construction materials to facilitate the measuring and marking of those dimensions on materials. One leg is marked along its edges with linear and angular measurement marks for measuring and marking lines and angles, and has holes disposed selectively along its length for receiving a marker, such as a carpentry pencil. The other leg is marked with angular measurement marks along its edges and has a window with pitch marks along the edges thereof to facilitate the measurement and marking of angles and pitch.

15 Claims, 3 Drawing Sheets

MULTI-PURPOSE SQUARE

BACKGROUND OF THE INVENTION

This invention relates to carpenters' tools, particularly to carpentry layout squares having an integral level, and measuring and marking elements corresponding to standard dimensions of construction materials, arranged to permit the layout of angular and linear dimensions using a single tool and to ease the framing of walls and the construction of roofing.

Various types of carpentry squares are widely used in many fields of construction. They are generally used to fit two pieces of material together perpendicularly, to square adjacent edges of, for example, a piece of lumber, and to mark lumber for framing walls. In addition, together with a level, carpentry squares are often used in determining or establishing the pitch of a roof in constructing and modifying roofs.

A framing square is one type of carpentry square. A typical framing square consists of a single piece of material formed in the shape of an "L", that is, two legs of unequal length joined to each other at a right angle, each leg having markings to indicate increments of linear measurement, these legs usually being between one and two feet long. Variations on the framing square provide integrated levels or at least one additional, usually adjustable leg.

Previously known forms of framing squares are subject to certain limitations. The typical framing square, while of simple construction and capable of straightforward use, tends to be overly bulky, and cannot readily be used to layout rafters in roofs or to plumb studs or level beams in framing walls without the simultaneous use of a leveling device. In addition, while the length of the typical framing square's legs is useful with respect to the long dimensions common to materials used in construction of buildings, the squares generally do not provide structure that relates the dimensions of the square's legs to the standard width and thickness dimensions of lumber, which dimensions are critical in laying out joints.

Those framing squares that integrate a leveling device with a framing square generally fail either to overcome the bulkiness limitation, to relate the dimensions of the square's legs to standard lumber dimensions, to provide structure that readily tolerates the angular layout of rafters or, if structure is provided that allows angles to be measured, to provide such structure so that the square can be used simultaneously to measure angular dimensions of rafters while laying out other roof members. Examples of the foregoing can be found in Whiteford U.S. Pat. No. 4,503,624 and Thibodeoux U.S. Pat. No. 4,394,801. Those squares that include scales for laying out angular dimensions similarly generally fail to provide structure that allows the square to be used simultaneously to measure angular dimensions of rafters while laying out other roof members. An example of the foregoing can be found in Russo U.S. Pat. No. 4,151,650.

Other squares increase the functionality of the typical framing square by adding a third leg. These squares tend to be of complex construction, with one or more legs being angularly or linearly adjustable and sometimes include a leveling device or other features. These squares tend to be difficult to use because of their complexity. Moreover, they do not provide structure that relates the dimensions of the square's legs to the standard width and thickness dimensions of lumber, which dimensions are critical in laying out joints. In addition, those squares that include a leveling device, though usable to measure the angular dimensions of rafters in constructing roofs, are not well constructed for the layout of the rafters and other roof members. Examples of the foregoing can be found in Herkimer U.S. Pat. No. 4,813,149 and Hopfer 4,697,351.

Because known conventional layout squares each have inherent limitations to their usefulness, a need exists for an improved layout square which more readily facilitates framing of structures.

SUMMARY OF THE INVENTION

The present invention fulfills the aforementioned need by providing a layout square that overcomes the limitations of prior art squares and provides certain advantages not heretofore available in a square. Specifically, the layout square of the present invention is constructed to relate the dimensions of the square's legs to the standard width and thickness dimensions of lumber so that joints may be readily laid out. The layout square includes an integral leveling device to allow for angular measurement, as well as for plumbing studs and leveling beams. It facilitates layout of rafters without the need to use other tools by providing such a leveling device and by providing for simultaneous measurement of angular dimensions of rafters and the laying out of other roof members. Moreover, the layout square of the present invention is constructed to fit in any standard carpenter's belt and has no parts that need to be adjusted and, therefore, is easy to use.

In the invention, the layout square comprises a handle to which two legs, referred to respectively herein as a "tongue" and a "body" are attached. Each of the handle, the tongue and the body are elongate and generally rectangular in shape. The longitudinal axes of both the tongue and the body are disposed perpendicular to the longitudinal axis of the handle, and the tongue and the body are attached so that they extend away from the handle in the same direction. The tongue preferably has linear measurement marks selectively disposed on its longitudinal axis in predetermined, regular increments along its edges, and has holes selectively disposed at predetermined, regular intervals along that longitudinal axis between the edges for receiving a marker, such as a carpentry pencil. The handle preferably is thicker than the tongue to permit the handle to be placed against an edge of a board and a line to be drawn by placing a marker through one of the holes, then sliding the square along the edge of the board in contact with the handle.

Another feature of the invention provides that the width of the tongue, the width of the body and the spacing between the tongue and the body are selected to correspond to a set of predetermined standard dimensions of materials used in construction. For example, the width of the tongue and the body would be selected to be 1½" and 3½", respectively, which dimensions correspond to the width and depth, respectively, of a standard two-by-four board; and the space between the body and the tongue would be selected to be ½", which not only is a standard dimension of certain boards, but also gives an overall width across the tongue and the body of 5½", a dimension corresponding to the depth of a standard two-by-six board.

A further feature of the invention integrates a leveling device in the handle and provides angular measurement marks on both the tongue and the body for framing rafters. The angular measurement marks indicate angles measured against level or against the longitudinal axis of the handle with the vertex located at the junction of the tongue and the handle. The handle is preferably thicker than the tongue so that the junction serves as a point of contact with a board about which the layout square can be pivoted, thereby permitting both the measurement of pitch of existing rafters and facilitating the layout of rafters and other roof members in constructing a roof. Moreover, the body preferably includes a window with pitch indicators marked along the edges of the window, which window permits boards to be aligned to said pitch markings for layout purposes. The integrated level also allows the handle to be placed against a board such as a stud to determine whether the board is plumb, or against a board such as a beam to determine whether the board is level.

Accordingly, a principal object of the present invention is to provide a novel and improved layout square.

Another object of the present invention is to provide a layout square having components with related dimensions selected to correspond to a set of predetermined standard dimensions of materials used in construction.

A further object of the present invention is to provide a layout square that includes a leveling device to allow angular measurement, as well as to provide plumbing and leveling functions.

Yet another object of the present invention is to provide a layout square that facilitates layout of rafters and other roof members, without the need to use additional tools, by providing for simultaneous measurement of the angular dimensions or the pitch of rafters and the laying out of other roof members.

Yet a further object of the present invention is to provide a layout square that is constructed to fit in any standard carpenter's belt.

Another object of the present invention is to provide a layout square that has no parts that need to be adjusted and, therefore, is easy to use, relatively maintenance free, economical to manufacture and inexpensive to purchase.

The foregoing and other objects, features, and advantages of the invention will be more readily understood upon consideration of the following detailed description of the invention, taken in conjunction with the accompanying drawings.

DETAILED DESCRIPTION OF THE INVENTION

Figure 1:
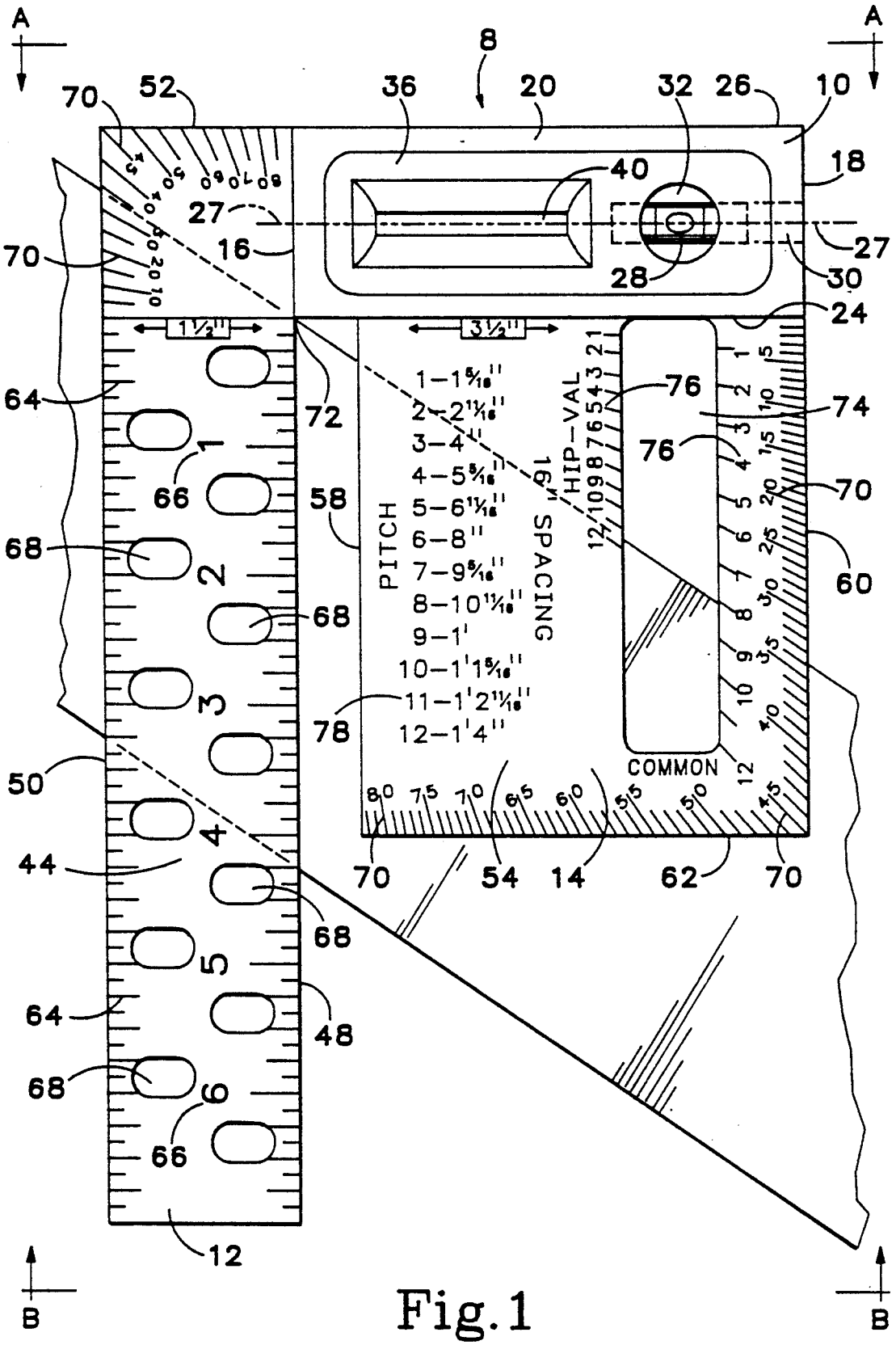
FIG. 1 shows a plan view of a preferred embodiment of a layout square according to the present invention, together with a board whose pitch is to be measured.
Figure 2:
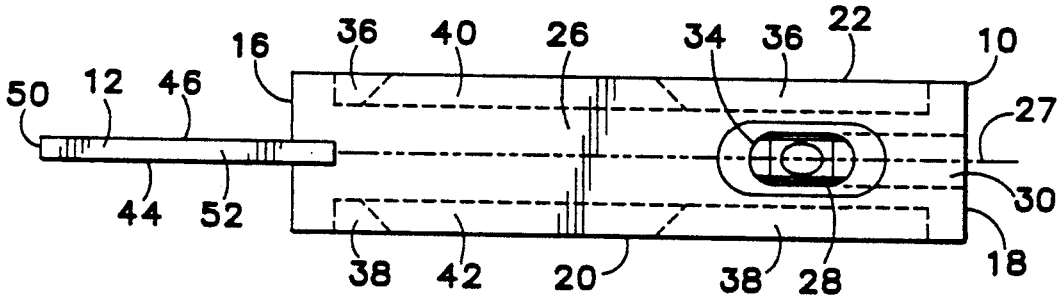
FIG. 2 shows a side elevation the layout square of FIG. 1 taken along line A—A thereof.
Figure 3:
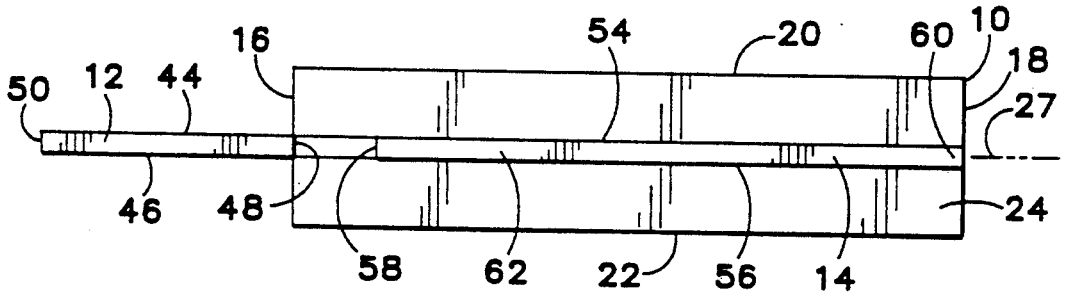
FIG. 3 shows a side elevation view of the layout square of FIG. 1 taken along line B—B thereof.

Referring to FIGS. 1, 2 and 3, a preferred embodiment of the layout square 8 in accordance with the present invention is shown. The layout square employs an elongate handle 10, an elongate tongue 12 and an elongate body 14. Each of these components is preferably substantially rectangular in shape, the handle in particular generally being in the shape of a rectangular prism. However, the tongue and body may be constructed of a single piece whereby only the exposed tongue and body portions are actually rectangular.

The handle 10 has a planar first end 16 and a planar second end 18 disposed opposite and parallel to one another. The handle 10 also has a planar top face 20 and a planar bottom face 22 disposed opposite and parallel to one another; and a planar inside face 24 and a planar outside face 26 disposed opposite and parallel to one another. Although in the embodiment shown the top face 20 and the bottom face 22 are planar and parallel, it is to be recognized that different shapes and orientations may be used without departing from the principles of the invention. The thickness of the handle 10, as determined by the distance between the top face 20 and the bottom face 22, i.e., the height of the inside of face 24, is preferably greater than the thickness of the tongue 12 and body 14, whose thicknesses are preferably identical, for reasons that will be discussed further below.

Figure 4:
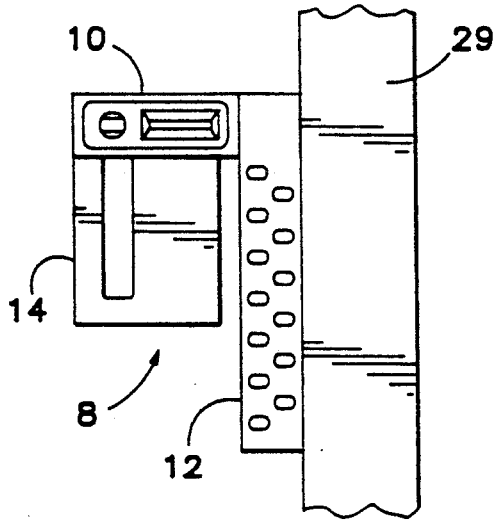
FIG. 4 shows the layout square of FIG. 1 in use to plumb a stud.
Figure 5:
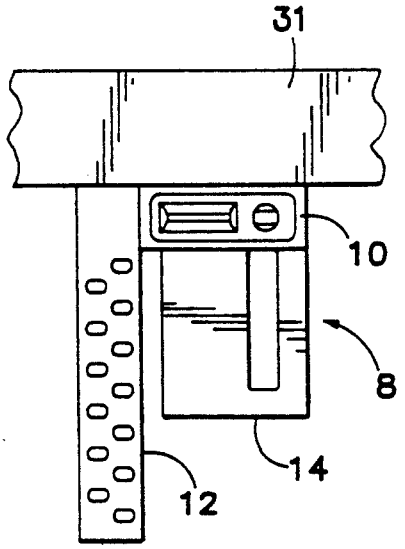
FIG. 5 shows a side view of the layout square of FIG. 1 in use in a first way to level a beam.
Figure 6:
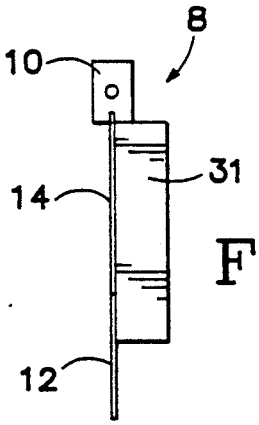
FIG. 6 shows an end view of the layout square of FIG. 1 in use in a second way to level a beam.

The handle 10 has a spirit level 28 disposed along the longitudinal axis of the handle 10, located off-center toward the second end 18 of the handle. The level 28 is inserted through a first aperture 30 and, once the level 28 is inserted, the aperture 30 is permanently sealed. The handle 10 has a second aperture 32 extending completely through the handle 10 from the top face 20 to the bottom face 22, and a third aperture 34 extending from the outside face 26 to the level 28. The second and third apertures 32 and 34 are disposed so that the level 28 may be read from each of faces 16, 18 and 22. The level 28 allows the handle 10 to be placed against a board 29, such as a stud, to determine whether the board 29 is plumb, as shown in FIG. 4, or against a board 31, such as a beam or a header, to determine whether the board 31 is level, as shown in FIGS. 5 and 6.

The handle 10 may be made of plastic, aluminum or wood, though it is preferably be made of hard plastic. Each of the top face 20 and the bottom face 22 have disposed therein channels 36 and 38, respectively, which demarcate lips 40 and 42, respectively, whereby the layout square may be gripped. However, it is to be recognized that the handle 10 may be constructed without the channels 36 and 38 or the lips 40 and 42 without departing from the principles of the invention.

The tongue 12 has a planar top face 44 and a planar bottom face 46 disposed opposite and parallel thereto. The tongue 12 also has a longitudinal inside edge 48 and a longitudinal outside edge 50, both of which are common to the faces 44 and 46 of the tongue 12. The tongue 12 also has a top edge 52 that is perpendicular to each of the edges 48 and 50 and that is common to the faces 44 and 46 of the tongue 12.

The tongue 12 is rigidly attached to the handle 10, the edges 48 and 50 of the tongue 12 being disposed perpendicular to the longitudinal axis of the handle 10, and the edge 48 being disposed flush with the first end 16 of the handle 10. In addition, the top edge 52 is disposed flush with the outside face 26 of the handle 10, and the faces 44 and 46 of the tongue 12 are disposed so that their planes are perpendicular to each of the inside face 24 and the outside face 26 of said handle 10. The tongue 12 preferably is attached along a center line 27 dividing the handle 10.

The body 14 has a planar top face 54 and a planar bottom face 56 disposed opposite and parallel thereto. The body 14 also has a longitudinal inside edge 58 and a longitudinal outside edge 60 both of which are common to the faces 54 and 56 of the body 14. The body 14 also has a bottom edge 62 that is perpendicular to each of the edges 58 and 60 and that is common to the faces 54 and 56 of the body 14.

The body 14 is rigidly attached to the handle 10 with the edges 58 and 60 of the body 14 disposed perpendicular to the longitudinal axis of the handle 10, and with the bottom edge 62 disposed parallel to the inside face 24 of the handle 10. In addition, the faces 54 and 56 of the body 14 are disposed so that their planes are perpendicular to each of the inside face 24 and the outside face 26 of said handle 10. In order for the faces 54 and 56 of the body 14 to be coplanar with the respective faces 44 and 46 of the tongue 12, the body 14 preferably is attached along the center line 27 dividing the handle 10.

Preferably, the tongue 12 and the body 14 are made of metal, e.g., aluminum, and are cast in one piece. However, it is to be recognized that the tongue 12 and the body 14 may be constructed from other materials and may be made other than in one piece without departing from the principles of the invention.

The tongue 12 preferably has linear measurement marks 64 selectively disposed in predetermined, preferably regular increments along the edges 48 and 50 on both of the faces 44 and 46. In the embodiment shown, the marks 64 are in increments of ⅛41 , have different lengths to indicate each ⅛", ¼", ½" and 1", and commence at a line extending in the plane of the inside face 24 of handle 10 across the tongue 12. The tongue 12 also preferably has arabic numerals 66 disposed at each 1" increment indicated by the marks 64.

In addition, the tongue 12 preferably has holes 68 extending completely through the tongue 12, selectively disposed at predetermined, preferably regular, and staggered intervals along the longitudinal axis of the tongue 12 between the edges 48 and 50. The holes 68 are selectively shaped for receiving marking instruments, such as a carpentry pencil. Moreover, since the thickness of the handle 10 is greater than the thickness of the tongue 12 (determined by the distance between the faces 44 and 46), the handle 10 may be placed against an edge of a board in order to draw a line by placing such a marking instrument through one of the holes 68 and then sliding the square along the edge of the board while keeping that edge in constant contact with the handle 10. Although in the embodiment shown the square has linear measurement marks 64, arabic numerals 66 and holes 68, it is to be recognized that other markings may be used, and that such features may be omitted, without departing from the principles of the invention.

The square is constructed with the tongue 12 and the body 14 having selected widths, each width equal to a standard lumber dimension, or the sum of a plurality of such dimensions, and have spacing between the tongue 12 and the body 14 selected so that the overall width from the outside edge 50 of the tongue 12 to the outside edge 60 of the body 14 corresponds to a predetermined standard lumber dimension, or the sum of a plurality of such dimensions.

Preferably, the width of the tongue and the body would be 1½" and 3½", respectively, which dimensions correspond to the width and depth, respectively, of a standard two-by-four board; and the space between the body and the tongue would be ½", which dimension not only is a standard dimension of certain boards, but also gives an overall width across the tongue and the body of 5½", a dimension corresponding to the depth of a standard two-by-six board. Although the above-identified dimensions correspond to the two standard boards used in framing walls and in constructing roofs, it is to be understood that different dimensions may be used that correspond to different board dimensions or to different materials in other applications, and that the dimensions may be changed to accommodate new standards from time-to-time, each without departing from the principles of the invention.

Figure 7:
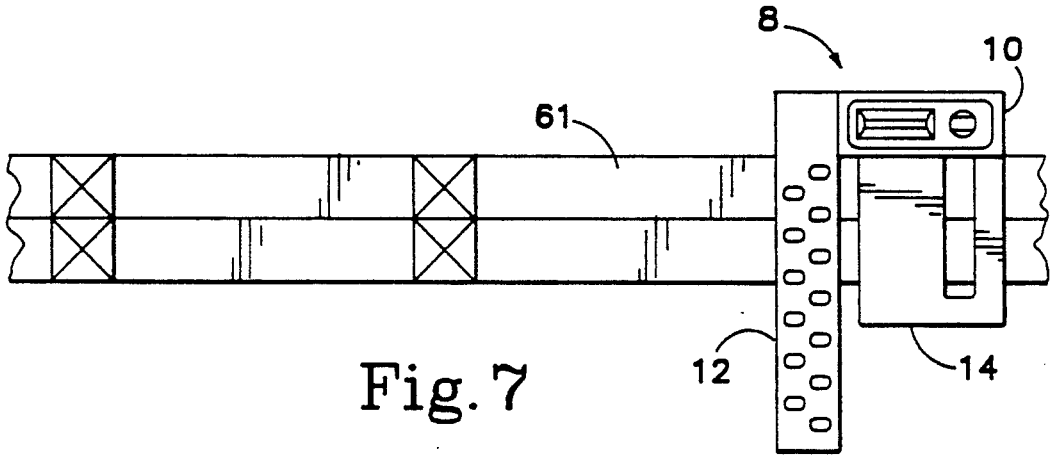
FIG. 7 shows the layout square of FIG. 1 in use to place marks on a beam corresponding to standard dimensions of lumber.

As shown in FIG. 7, in marking a beam 61, the square is placed over the beam with the inside face 24 of the handle 10 flush with a face of the beam that is adjacent and perpendicular to the face to be marked. Then, by marking on both edges 48 and 50 of the tongue 12, marks are obtained that are spaced 1½" apart and perpendicular to the longitudinal axis of the beam, thereby indicating, for example, where the edge of a two-by-four should be placed. Alternatively, the marks could be made on the edges 58 and 60 of the body 14 if spacing of 3½" is desired, or on the outside edges 50 and 60 of, respectively, the tongue 12 and the body 14 if spacing of 5½" is desired. Other combinations of edges may also be used to make marks, as desired.

The square is also constructed to provide angular measurement marks 70 on the tongue 12 and the body 14. The angular measurement marks 70 indicate angles in degrees with a common vertex located at the junction 72 of the inside edge 48 of the tongue 12 and the inside face 24 of the handle 10. Since the handle 10 is preferably thicker than the tongue 12, the junction 72 serves as a point of contact with a board about which the layout square can be pivoted. As shown in FIG. 1, the angular pitch of an existing rafter is measured as approximately 33⅓ degrees by pivoting the square at the junction 72 on the rafter until the level 28 indicates the square is level, at which point the angular pitch of the rafter is read from the marks 70. In constructing a roof, rafters are marked by pivoting the square by the junction 72 on the rafter until the rafter aligns with the desired mark 70, at which point the rafter is marked.

The body 14 has a substantially rectangular window 74 with pitch indicators 76 marked along the edges of the window. The window 74 permits boards to be aligned to said pitch markings for layout purposes. The face 54 of the body 14 is also marked with a table 78 that translates the pitch indicators 76 into rise values corresponding to a fixed run value. Although in the embodiment shown the fixed run value is 16", it is to be recognized that other fixed values could be used without departing from the principles of the invention. Preferably, the face 56 of the body 14 would also be marked with a table, translating the pitch markers either into rise values for an alternative fixed rise value or into angular degrees. Pitch can be measured for existing rafters or marked for rafters to be constructed using pitch indicators 76 and table 78 using the methods described above for angular measurement marks 70.

The terms and expressions which have been employed in the foregoing specification are employed therein as terms of description and not of limitation, and there is no intention in the use of such terms and expressions of excluding equivalents of the features shown and described or portions thereof, it being recognized that the scope of the invention is defined and limited only by the claims which follow.

I claim:

1. A multi-purpose square for use in marking locations at which to position dimensional lumber, sheathing materials, plywoods or other construction materials according to the predetermined width or thickness dimensions of the dimensional lumber, sheathing materials, plywoods or other construction materials, comprising:

(a) an elongate handle having a first end and a second end and at least one substantially planar face therebetween;

(b) a substantially planar tongue attached to said handle and having an axis perpendicular to said planar face so that said tongue extends away from said face, said tongue having a first edge and a second edge, both said edges being parallel to said axis of said tongue and spaced a first predetermined distance apart corresponding to a dimension of the dimensional lumber, sheathing materials, plywoods or other construction materials;

(c) a substantially planar body attached to said handle and having an axis perpendicular to said planar face so that said body extends away from said face and parallel to said axis of said tongue, said body having a first edge, a second edge and a third edge, both said first edge and said second edge being parallel to said axis of said body and spaced a second predetermined distance apart corresponding to the sum of one or more of the dimensions of the dimensional lumber, sheathing materials, plywoods and other construction materials, said second edge of said tongue being spaced from said first edge of said body a third predetermined distance, there being a clear space therebetween, said third predetermined distance corresponding to the sum of one or more dimensions of the dimensional lumber, sheathing materials, plywoods or other construction materials so that the distance between any two of said edges of said tongue and said body corresponds to the sum of one or more of the dimensions of the dimensional lumber, sheathing materials, plywoods or other construction materials, whereby any combination of two of said first and second edges of said tongue and said body may be used independently of any other combination of two of said first and second edges of said tongue and said body to mark locations at which to position the dimensional lumber, sheathing materials, plywoods or other construction materials, said locations being entirely user-selectable alone or relative to each other, said third edge of said body being substantially parallel to said planar face of said handle, the thickness of said tongue and said body being substantially equal and the height of said planar face being greater than said thickness;

(d) pivot means, formed by the intersection of said second edge of said tongue and said planar face of said handle for measuring angles along said second edge and said third edge of said body, a portion of said handle terminating at said intersection so as to provide a pivot axis;

(e) markings along at least one edge of said body comprising segments of lines passing through said intersection, said markings being spaced from one another at predetermined angular intervals, thereby serving as pitch indicators; and (f) leveling means, disposed in said square, for aligning said square with respect to a level reference so that said angles can be selectively measured relative to level when said square is pivoted about said pivot axis.

2. The multi-purpose square of claim 1, wherein said first predetermined distance is 1½ inches, said second predetermined distance is 3½ inches, said third predetermined distance is ½ inch, so that said distance between said first edge of said tongue and said second edge of said body is 5½ inches and all said distances correspond to sums of one or more dimensions of the dimensional lumber, sheathing materials, plywoods and other construction materials.

3. The multi-purpose square of claim 1, wherein said body includes a rectangular aperture formed therein having a width and a length, the elongate axis of said aperture being disposed parallel to said axis of said body, said width of said aperture corresponding to a sum of one or more of said dimensions of the dimensional lumber, sheathing materials, plywoods and other construction materials.

4. The multi-purpose square of claim 1, wherein said tongue and said body are one piece.

5. The multi-purpose square of claim 1, wherein said tongue and said body are attached to said handle along a line substantially bisecting said planar face.

6. The multi-purpose square of claim 1, wherein said tongue has a first side and a second side and linear measurement marks selectively disposed in predetermined increments along at least one edge and on at least one side thereof.

7. The multi-purpose square of claim 1, wherein said tongue has holes selectively disposed at predetermined intervals along the longitudinal axis.

8. The multi-purpose square of claim 1, wherein said handle has a top face and a bottom face, both substantially perpendicular to said planar face, and means for gripping said handle, comprising a first channel cut into said top face and a second channel cut into said bottom face, said channels demarcating lips by which said square may be gripped.

9. The multi-purpose square of claim 1, wherein said body includes a rectangular aperture formed therein, the elongate axis of said aperture being disposed parallel to said axis of said body, at least one edge of said aperture in the elongate dimension having said markings as well.

10. The multi-purpose square of claim 1, wherein said body has a table marked on at least one face of said body, and said table selectively translates said pitch indicators either into rise values corresponding to a fixed run value or into angular degrees.

11. The multi-purpose square of claim 1, wherein said leveling means is disposed in said handle, for providing an indication of whether the elongate dimension of said handle is level or not.

12. The multi-purpose square of claim 11, wherein said leveling means comprises a spirit level disposed within said handle with its elongate dimension parallel to the elongate dimension of said handle.

13. The multi-purpose square of claim 12, wherein said handle has a top face and a bottom face, both substantially perpendicular to said planar face, further comprising holes disposed in said handle, said holes disposed so that said spirit level may be read from any of said top face, said bottom face or said outside face of said handle.

14. The multi-purpose square of claim 1, wherein said markings are disposed on said second edge and said third edge of said body.

15. The multi-purpose square of claim 1, wherein the lengths of said body and said tongue are different from one another.

* * * * *